US009764214B1

(12) United States Patent
Martin

(10) Patent No.: US 9,764,214 B1
(45) Date of Patent: Sep. 19, 2017

(54) CHALK DISPENSING GOLF TRAINING AID APPARATUS TO ENHANCE BALL AND CLUB ALIGNMENT

(71) Applicant: Howard Newton Martin, Vail, AZ (US)

(72) Inventor: Howard Newton Martin, Vail, AZ (US)

( * ) Notice: Subject to any disclaimer, the term of this patent is extended or adjusted under 35 U.S.C. 154(b) by 0 days.

(21) Appl. No.: 15/056,690

(22) Filed: Feb. 29, 2016

(51) Int. Cl.
*A63B 69/36* (2006.01)
*A63B 57/00* (2015.01)

(52) U.S. Cl.
CPC ..... *A63B 69/3641* (2013.01); *A63B 2209/00* (2013.01)

(58) Field of Classification Search
USPC ..... 473/422, 237, 280, 577, 570; 483/20–22
See application file for complete search history.

(56) References Cited

U.S. PATENT DOCUMENTS 5,120,358 A * 6/1992 Pippett ..... C09D 13/00 106/272
2007/0054755 A1* 3/2007 Cornfield ..... B43K 7/00 473/406
2008/0039248 A1* 2/2008 Witzigreuter ..... F42B 12/40 473/577
2013/0085019 A1* 4/2013 Hudack, III ..... A63B 67/00 473/415

* cited by examiner

*Primary Examiner* — Nini Legesse
(74) *Attorney, Agent, or Firm* — Plager Schack LLP

(57) ABSTRACT

A golf training aid apparatus to dispense a chalk line on a ground surface to serve as a reference to enhance alignment of a ball, club face and feet of a user includes an outer tubular member having a first dispensing slot, an inner tubular member rotatably mounted to the outer tubular member and designed to store the chalk, the inner tubular member having a second dispensing slot, and an adjustment member designed to limit rotational movement of the inner tubular member relative to the outer tubular member. The inner tubular member is rotatably adjusted to enable the first dispensing slot of the outer tubular member to align with the second dispensing slot of the inner tubular member, thereby permitting the stored chalk to pass through the first and second dispensing slots to dispense the chalk line on the ground surface.

10 Claims, 4 Drawing Sheets

CHALK DISPENSING GOLF TRAINING AID APPARATUS TO ENHANCE BALL AND CLUB ALIGNMENT

BACKGROUND

The embodiments herein relate generally to golf devices to help a golfer to achieve a proper alignment of the ball, club face and feet with respect to a shooting target.

Golf alignment tools are often used by golfers during practice sessions at the driving range and/or putting green. These golf alignment tools typically comprise long sticks that are placed on the ground. The golfer aligns the stick with the shooting target. The golf ball is placed in close proximity to the stick and the golfer positions the club face and his/her feet based on the position of the stick. These golf alignment tools are undesirable because they are difficult to use when determining if a user's positioning is correct. Specifically, since the stick is placed on the ground a distance away from the golfer, alignment errors can occur when the golfer aligns the club face, ball and feet relative to the stick and shooting target. A slight degree offset in positioning can produce a severe miss and give misleading information about the alignment of the golf swing.

As such, there is a need in the industry for a golf alignment tool that addresses the limitations of the prior art. In particular, there is a need for a chalk dispensing apparatus that, when aligned to the target, dispenses a chalk line directly on the ground surface and permits the golfer to place the ball directly on the chalk line. This greatly enhances the golfer's ball, club and feet alignment accuracy.

SUMMARY

A golf training aid apparatus configured to store chalk and dispense a chalk line on a ground surface to serve as a reference to enhance alignment of a ball, club face and feet of a user is provided. The golf training aid apparatus comprises an outer tubular member comprising a first end, a second end opposite the first end, and a first dispensing slot disposed on a side wall of the outer tubular member, an inner tubular member rotatably mounted to an interior of the outer tubular member and configured to store the chalk, the inner tubular member comprising a first end, a second end opposite the first end, and a second dispensing slot disposed on a side wall of the inner tubular member, and an adjustment member operably connected to the outer and inner tubular members and configured to limit rotational movement of the inner tubular member relative to the outer tubular member, wherein the inner tubular member is rotatably adjusted within an allowable range of motion as permitted by the adjustment member to enable the first dispensing slot of the outer tubular member to align with the second dispensing slot of the inner tubular member, thereby permitting the stored chalk in the inner tubular member to pass through the first and second dispensing slots to dispense the chalk line on the ground surface.

In certain embodiments, the first dispensing slot comprises a first set of apertures disposed on the side wall of the outer tubular member and the second dispensing slot comprises a second set of apertures disposed on the side wall of the inner tubular member.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
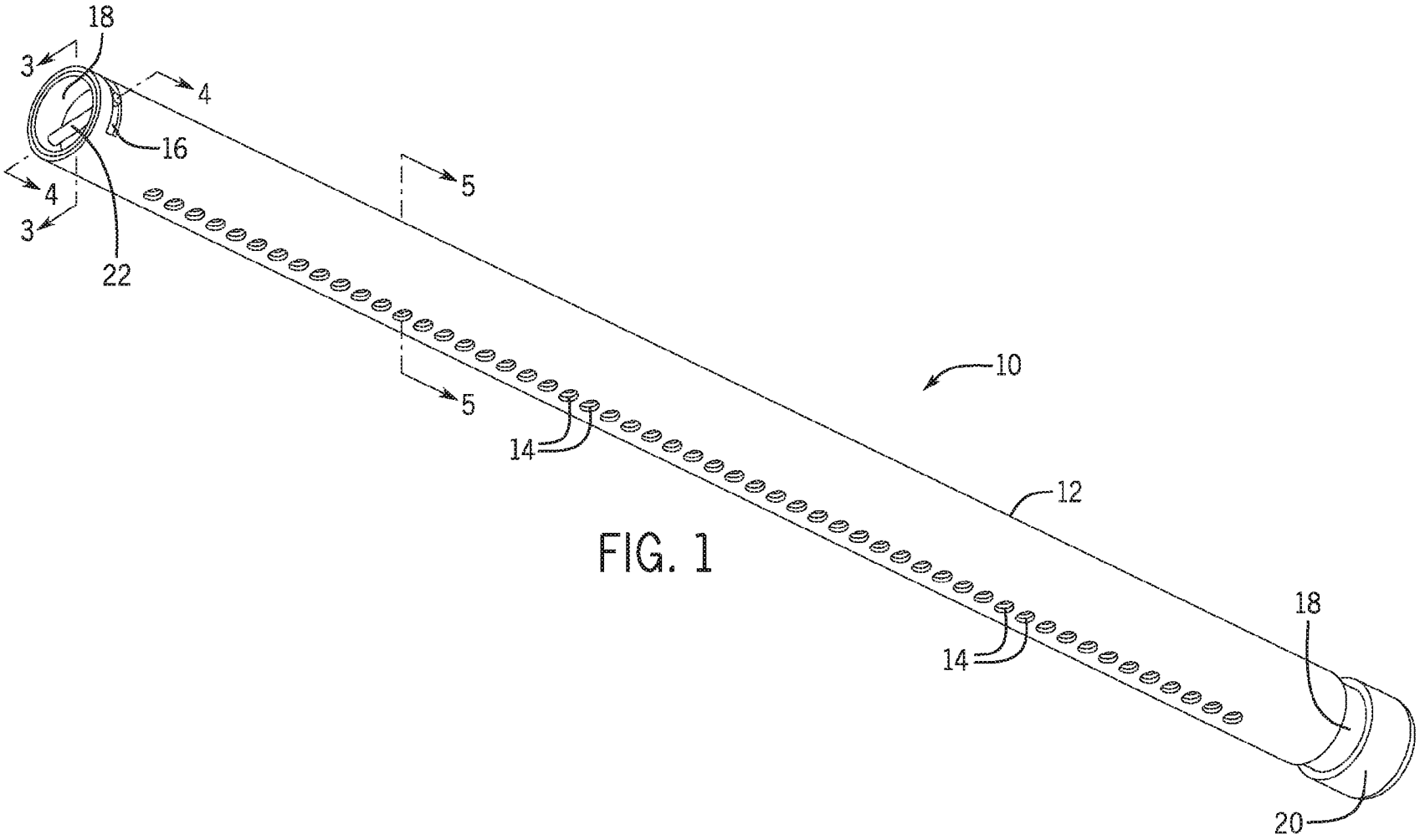
FIG. 1 depicts a bottom perspective view of certain embodiments of the golf aid apparatus.
Figure 2:
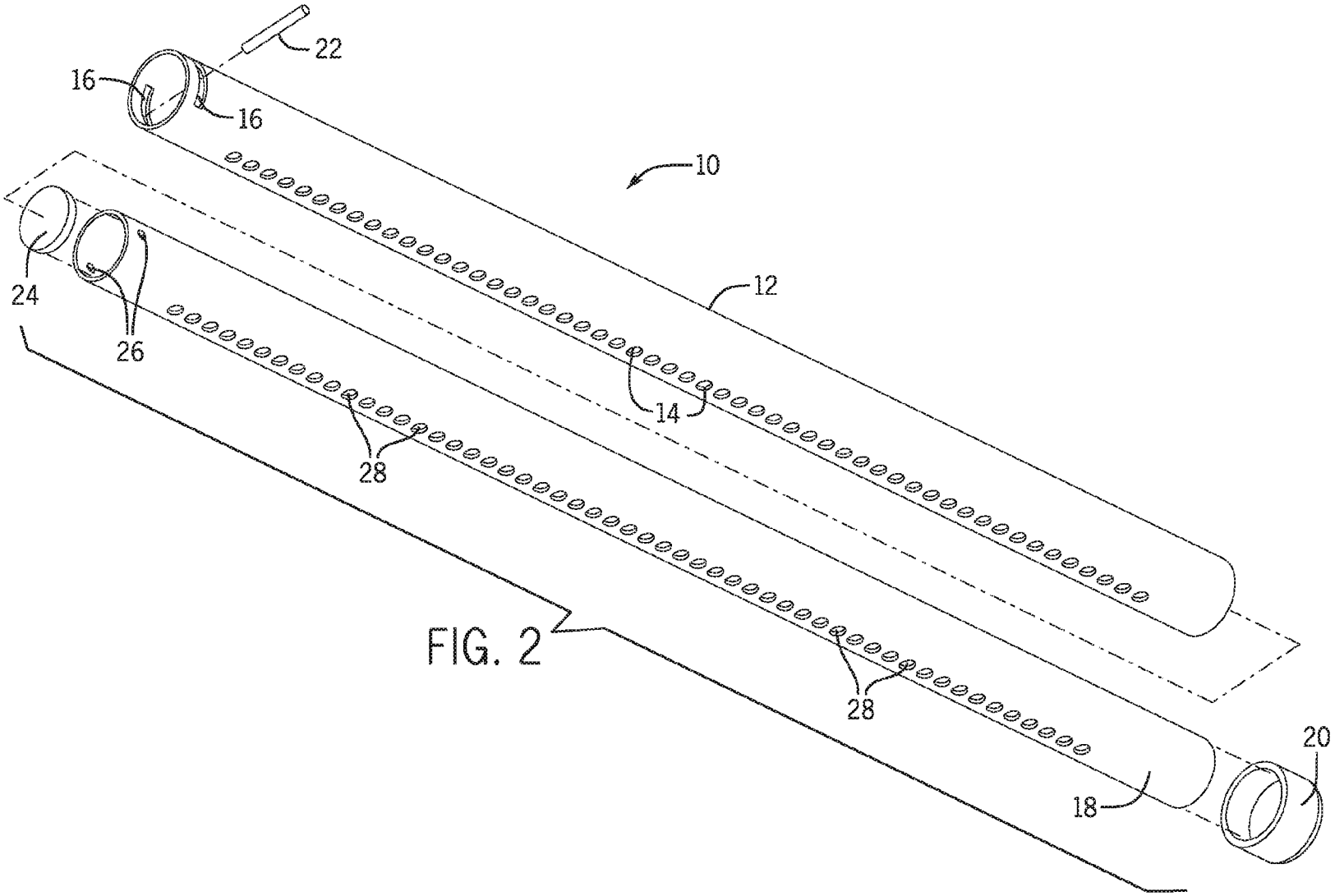
FIG. 2 depicts an exploded view of certain embodiments of the golf aid apparatus.

As depicted in FIGS. 1-2, golf training aid apparatus 10 generally comprises outer control tube 12 and inner chalk tube 18, and is configured to dispense a chalk line (not shown) on the ground to serve as a reference to permit a user (not shown) to improve accuracy in aligning the ball, clubface and his/her feet in relation to the chalk line and a shooting target. The chalk line is designed to point toward the shooting target. Therefore, when the user's ball, clubface and feet are properly aligned with the chalk line, the user is in the proper position to shoot the ball towards the shooting target.

Outer control tube 12 comprises a tubular member with a pair of slots 16 and outer dispensing apertures 14. The pair of slots 16 is aligned with each other on the side wall of outer control tube 12. In one embodiment, outer control tube 12 comprises an approximate length of 2-4 feet and outer diameter of 1". However, the dimensions of outer control tube 12 may vary.

Inner chalk tube 18 comprises a tubular member rotatably mounted within outer control tube 12. Inner chalk tube 18 comprises inner dispensing apertures 28 and a pair of pin holes 26 at one end. The pair of pin holes 26 is aligned with each other on the sidewall of inner chalk tube 18. In one embodiment, inner chalk tube 18 comprises an approximate length of 2-4 feet, but is longer in length than outer control tube 12. This permits the ends of inner chalk tube 18 to extend outside outer control tube 12. The diameter of inner chalk tube 18 is slightly smaller than the diameter of outer control tube 12 to permit inner chalk tube 18 to be inserted within outer control tube 12.

In an alternative embodiment, inner dispensing apertures 28 of inner chalk tube 18 can be replaced by a single elongated slot. Similarly, outer dispensing apertures 14 of outer control tube 12 can be replaced by a corresponding single elongated slot.

Figure 3:
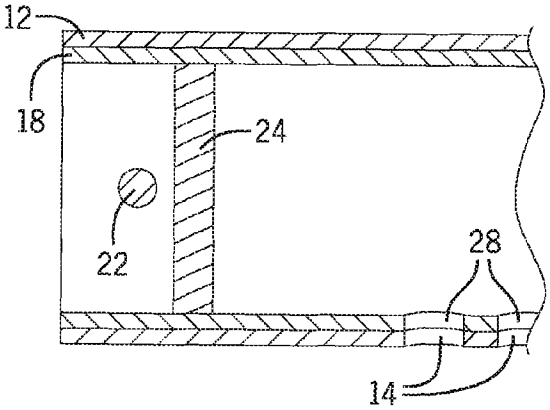
FIG. 3 depicts a section view of certain embodiments of the golf aid apparatus taken along line 3-3 in FIG. 1.

Plug 24 and cap 20 are coupled to inner chalk tube 18. Plug 24 is configured to serve as a permanent seal to inner chalk tube 18 and is coupled to the interior of the tube proximate a first end by an adhesive. It shall be appreciated that alternative fastening components may be used instead. As depicted in FIG. 3, plug 24 is secured to inner chalk tube 18 next to pin holes 26 and pin 22. Cap 20 slides over the second end of inner chalk tube 18 and can be easily attached to or removed from the tube.

Figure 4:
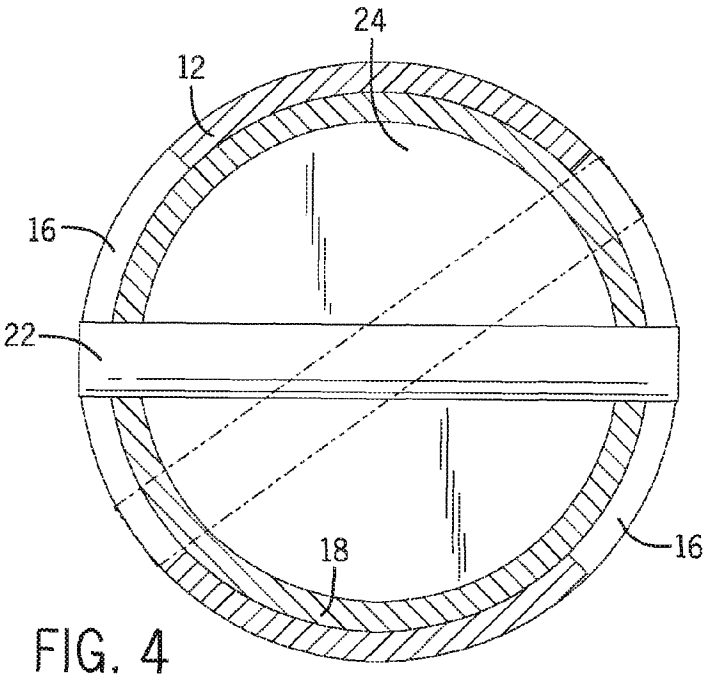
FIG. 4 depicts a section view of certain embodiments of the golf aid apparatus taken along line 4-4 in FIG. 1.

An adjustment member such as pin 22 is used to limit the range of rotational movement of inner chalk tube 18 relative to outer control tube 12. Pin 22 is inserted through slots 16 of outer control tube 12 and pin holes 26 of inner chalk tube 18. As depicted in FIG. 4, the ends of pin 22 extend into slots 16 of outer control tube 12. Therefore, the rotational movement of inner chalk tube 18 is limited by the movement of pin 22 within slots 16 of outer control tube 12. In one embodiment, each slot 16 comprises a length that is approximately ¼ the circumference of outer control tube 12. However, the dimensions of slot 16 can vary.

Figure 5:
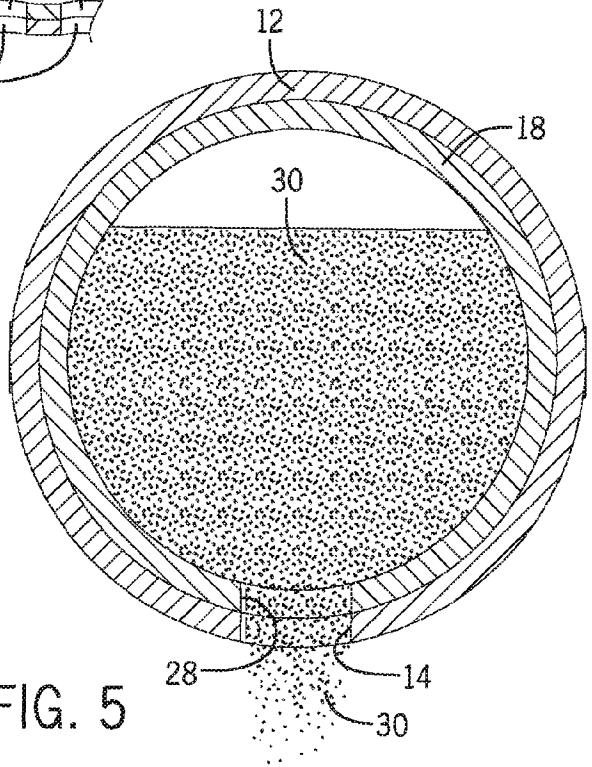
FIG. 5 depicts a section view of certain embodiments of the golf aid apparatus taken along line 5-5 in FIG. 1.
Figure 6:
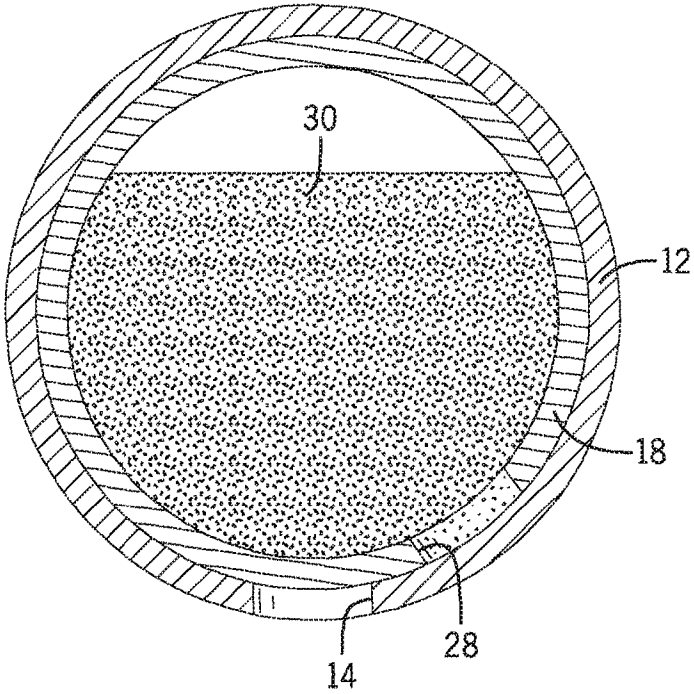
FIG. 6 depicts a section view of certain embodiments of the golf aid apparatus.
Figure 7:
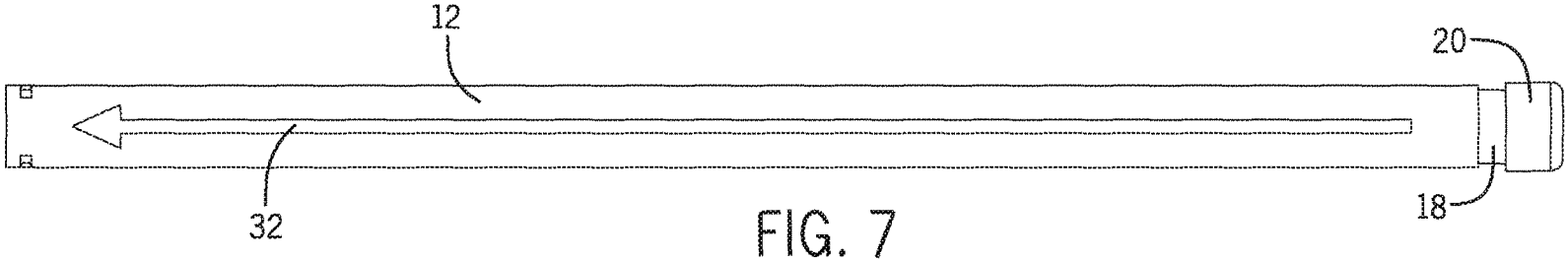
FIG. 7 depicts a top plan view of certain embodiments of the golf aid apparatus.

In operation, golf training aid apparatus 10 is prepared by removing cap 20 from inner chalk tube 18. This permits chalk 30 to be poured into the open end and into inner chalk tube 18. Cap 20 is placed on the end of inner chalk tube 18 to store chalk 30 therein. The user (not shown) places golf training aid apparatus 10 on the ground. In one embodiment, outer control tube 12 of golf training aid apparatus 10 comprises alignment arrow 32 as shown in FIG. 7. Alignment arrow 32 serves as a visual aid that helps the user to point golf training aid apparatus 10 towards the shooting target. Once golf training aid apparatus 10 is correctly positioned, the user rotates cap 20 manually by hand to rotate inner chalk tube 18 relative to outer control tube 12 to align inner dispensing apertures 28 with outer dispensing apertures 14. As depicted in FIG. 5, the alignment of inner dispensing apertures 28 of inner chalk tube 18 with outer dispensing apertures 14 of outer control tube 12 permits chalk 30 in inner chalk tube 18 to pass through dispensing apertures 28, 14, which dispenses a chalk line on the ground. To prevent additional chalk 30 from dispensing out of golf training aid apparatus 10, the user rotates inner chalk tube 18 until inner dispensing apertures 28 are not aligned with outer dispensing apertures 14 as shown in FIG. 6. The user can rotate inner chalk tube 18 as many times as desired to dispense more chalk 30 on the ground. Since the rotational movement of inner chalk tube 18 is limited by pin 22 within slots 16 of outer control tube 12, the user is required minimal effort to quickly align or separate inner dispensing apertures 28 and outer dispensing apertures 14 as needed.

Golf training aid apparatus 10 is removed from the ground once the dispensed chalk line is acceptable to the user. Since the chalk line is pointed towards the shooting target, the user can use the line as a reference to properly align the ball, club and body for the shot. The user places a ball directly on the chalk line and lines up the club face and feet. Specifically, the club face is lined up perpendicular to the chalk line. Once the golfer's feet, club face and ball are aligned properly, the golfer completes a golf swing to shoot the ball towards the target.

It shall be appreciated that the components of golf training aid apparatus 10 described in several embodiments herein may comprise any known materials in the field and be of any color, size and/or dimensions. It shall be appreciated that the components of golf training aid apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A golf training aid apparatus configured to store chalk and dispense a chalk line on a ground surface to serve as a reference to enhance alignment of a ball, club face and feet of a user, the golf aid training apparatus comprising:

an outer tubular member comprising a first end, a second end opposite the first end, and a first set of dispensing apertures disposed on a side wall of the outer tubular member;

an inner tubular member rotatably mounted to an interior of the outer tubular member and configured to store the chalk, the inner tubular member comprising a first end, a second end opposite the first end, and a second set of dispensing apertures disposed on a side wall of the inner tubular member; and an adjustment member operably connected to the outer and inner tubular members and configured to limit rotational movement of the inner tubular member relative to the outer tubular member;

wherein the inner tubular member is rotatably adjusted within an allowable range of motion as permitted by the adjustment member to enable the first set of dispensing apertures in the outer tubular member to align with the second set of dispensing apertures in the inner tubular member, thereby permitting the stored chalk in the inner tubular member to pass through the first and second sets of dispensing apertures to dispense the chalk line on the ground surface.

2. The golf aid training apparatus of claim 1, wherein the outer tubular member comprises a pair of adjustment member slots disposed on the side wall, wherein the inner tubular member comprises a pair of holes in the side wall.

3. The golf aid training apparatus of claim 2, wherein the adjustment member comprises a pin disposed within the pair of holes in the inner tubular member, the ends of the pin extending into the pair of adjustment member slots of the outer tubular member, wherein rotational movement of the inner tubular member is limited by movement of the pin within the pair of adjustment member slots of the outer tubular member.

4. The golf training aid apparatus of claim 3, wherein the inner tubular member comprises a first length that is greater than a second length of the outer tubular member.

5. The golf training aid apparatus of claim 4, further comprising a plug inserted within the inner tubular member proximate the first end.

6. The golf training aid apparatus of claim 5, further comprising a cap detachably coupled to the second end of the inner tubular member.

7. The golf training aid apparatus of claim 6, further comprising an alignment arrow disposed on the outer tubular member.

8. A golf training aid apparatus configured to store chalk and dispense a chalk line on a ground surface to serve as a reference to enhance alignment of a ball, club face and feet of a user, the golf aid training apparatus comprising:

an outer tubular member comprising a first end, a second end opposite the first end, and a first elongated slot disposed on a side wall of the outer tubular member;

an inner tubular member rotatably mounted to an interior of the outer tubular member and configured to store the chalk, the inner tubular member comprising a first end, a second end opposite the first end, and a second elongated slot disposed on a side wall of the inner tubular member; and an adjustment member operably connected to the outer and inner tubular members and configured to limit rotational movement of the inner tubular member relative to the outer tubular member;

wherein the inner tubular member is rotatably adjusted within an allowable range of motion as permitted by the adjustment member to enable the first elongated slot in the outer tubular member to align with the second elongated slot in the inner tubular member, thereby permitting the stored chalk in the inner tubular member to pass through the first and second elongated slots to dispense the chalk line on the ground surface.

9. The golf aid training apparatus of claim 8, wherein the outer tubular member comprises a pair of adjustment member slots disposed on the side wall, wherein the inner tubular member comprises a pair of holes in the side wall.

10. The golf aid training apparatus of claim 9, wherein the adjustment member comprises a pin disposed within the pair of holes in the inner tubular member, the ends of the pin extending into the pair of adjustment member slots of the outer tubular member, wherein rotational movement of the inner tubular member is limited by movement of the pin within the pair of adjustment member slots of the outer tubular member.

* * * * *